United States Patent [19]

Renteria

[11] 4,140,893

[45] Feb. 20, 1979

[54] BALL WARMING APPARATUS AND METHODS OF CONSTRUCTING AND UTILIZING SAME

[76] Inventor: Don Renteria, 7205 Anna, Warren, Mich. 48092

[21] Appl. No.: 794,561

[22] Filed: May 6, 1977

[51] Int. Cl.[2] ..... F26B 21/00

[52] U.S. Cl. ..... 219/385; 34/104; 34/225; 219/366; 219/386; 219/400; 219/521; 219/528; 219/535

[58] Field of Search ..... 219/214, 366, 385–387, 219/400, 401, 520, 521, 526, 527, 535, 368; 34/201, 202, 243 A, 103–108, 218–224

[56] References Cited

U.S. PATENT DOCUMENTS

| | | | |
|---|---|---|---|
| 1,455,287 | 5/1923 | Hadley | 219/528 |
| 2,108,376 | 2/1938 | Copeland | 219/385 |
| 2,231,506 | 2/1941 | Morey | 219/535 |
| 2,357,960 | 9/1944 | Kuster et al. | 34/104 |
| 2,482,665 | 9/1949 | Geyer | 219/535 |
| 2,617,012 | 11/1952 | Westley | 219/385 |
| 3,032,891 | 5/1962 | Parker | 219/527 |
| 3,091,681 | 5/1963 | Mayer | 219/523 |
| 3,320,681 | 5/1967 | Watlington | 34/202 |
| 3,586,516 | 6/1971 | Terc | 219/400 |
| 3,624,346 | 11/1971 | Guth | 219/201 |
| 3,683,155 | 8/1972 | Loofbourow | 219/521 |
| 3,686,774 | 8/1972 | Beadle, Jr. | 219/400 |

FOREIGN PATENT DOCUMENTS

| | | | |
|---|---|---|---|
| 645843 | 11/1950 | United Kingdom | 219/383 |
| 1264165 | 2/1972 | United Kingdom | 219/521 |

*Primary Examiner*—J. V. Truhe
*Assistant Examiner*—Bernard Roskoski
*Attorney, Agent, or Firm*—Irving M. Weiner; Pamela S. Austin; Melvin Yedlin

[57] ABSTRACT

A ball warming apparatus adapted to completely and effectively heat a cold ball, particularly a bowling ball, to a desirable room temperature. The apparatus may be adapted for selective stationary positioning within a bowling alley for coin-operation, or for selective portable use as a bowling ball bag. The inner wall of the appratus is adapted to closely encompass a bowling ball and to substantially heat the entire peripheral surface of the ball.

4 Claims, 4 Drawing Figures

FIG. 1
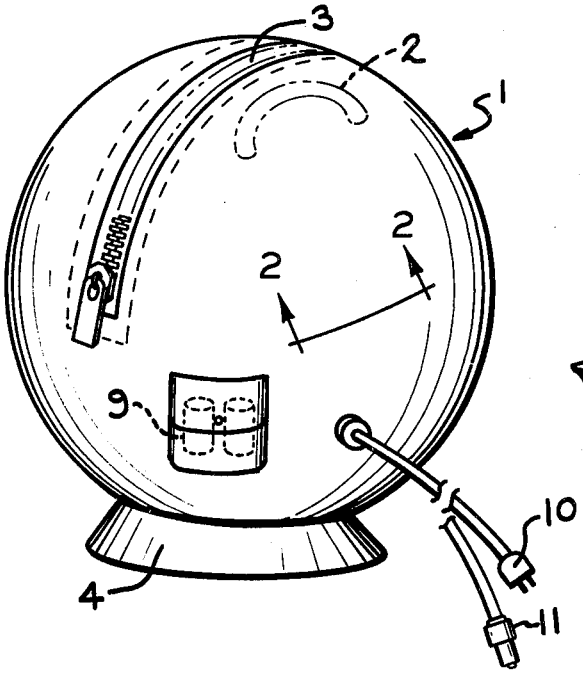
FIG. 2
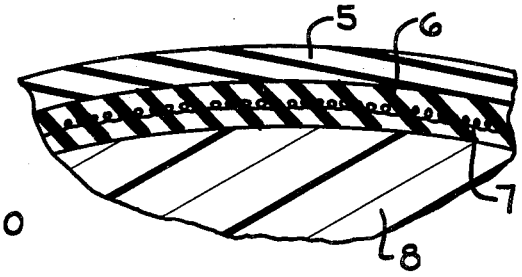
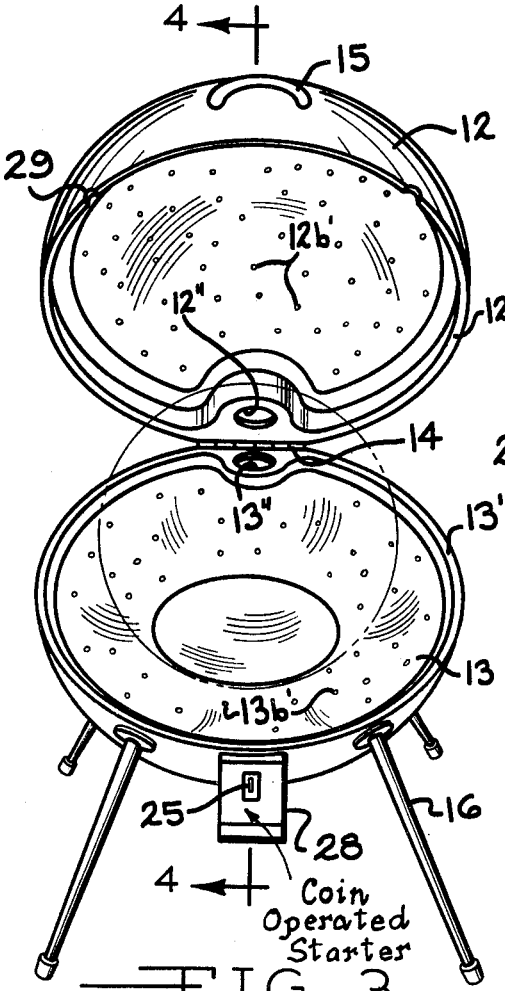
FIG. 3
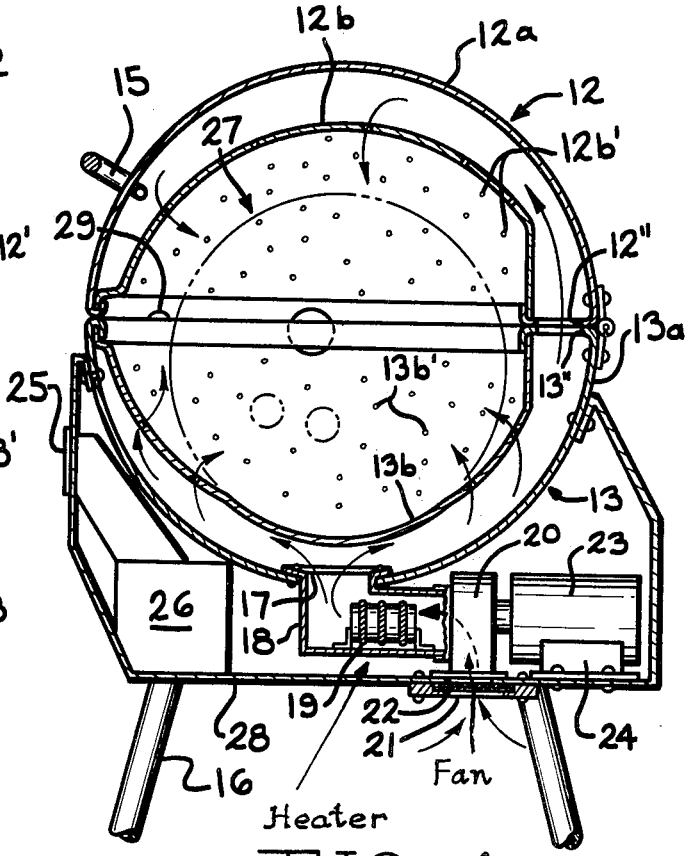
FIG. 4

BALL WARMING APPARATUS AND METHODS OF CONSTRUCTING AND UTILIZING SAME

BACKGROUND OF THE INVENTION

1. Field of the Invention

The present invention relates generally to an apparatus for readily and effectively heating a ball contained therein, and methods of constructing and utilizing such apparatus.

In particular, the present invention relates to a substantially spherical bowling ball heating apparatus having an inner heating wall or layer adapted to substantially heat the entire periphery of a bowling ball.

2. Description of the Prior Art

Heretofore, there has not been developed any generally acceptable or workable device which has provided ready and effective heating of a cold bowling ball.

Bowling activities have become increasingly popular, and in those instances when a bowling ball is transported from the user's home to the bowling alley in a climate marked with cold temperature conditions, and particularly when the ball is subjected to such cold temperature conditions for a long period of time, such as when left in an automobile, the use of the cold ball has proven to be uncomfortable and inconvenient. This is especially true in the first bowling game after transporting the ball out of the cold outdoors to the bowling lane. Not only is the cold temperature of the ball uncomfortable to the hands of the user thus affecting his bowling ability, but in addition there is the possibility that the ball, especially if it is fabricated of plastic, may crack or break when subjected to the rigorous use inherent with a bowling game.

Consequently, there has developed a need for a device which effectively and conveniently warms a cold bowling ball prior to its use in a bowling game. Illustrative of prior art attempts for a device of this nature is: the "BOWLING BALL BAG" disclosed in U.S. Pat. No. 2,617,012 issued in 1952 to Westley; the "HEATER FOR BOWLING BALLS" disclosed in U.S. Pat. No. 3,091,681 issued in 1963 to Mayer; and the "BOWLING BALL BAG" disclosed in U.S. Pat. No. 3,624,346 issued in 1971 to Guth.

Such prior art devices have proven ineffective to the extent that they do not effectively heat the entire peripheral surface of the ball in a convenient and ready manner.

The present invention eliminates the disadvantages and shortcomings attendant the prior art techniques, and at the same time provides a device which employs a minimum of parts at a reduced cost of manufacture.

SUMMARY OF THE INVENTION

The present invention provides a ball warming apparatus which includes a first ball receiving member provided with an opening for receiving the ball to be warmed. Closure means cooperate with the opening to substantially seal the first member from ambient conditions, and the first member is provided with inner heating means substantially co-extensive with the entire inner surface thereof for heating the entire peripheral surface of the ball. An electrical power source is connected to the inner heating means.

In a preferred embodiment of the invention, the first member includes a base portion and lid portion which are each hemispherically shaped, are pivotably connected to each other, and are of suitable dimensions so as to closely encompass the bowling ball received therein. Platform means is secured to the base portion for permitting the first member to be selectively stationarily positioned on a suitable horizontal surface in a bowling alley. The apparatus includes a coin-operated blower fan and heating coil arrangement to direct heated air between spaced apart inner and outer walls of the base and lid portions to heat the entire peripheral surface of the bowling ball.

It is an object of the present invention to provide a bowling ball warming apparatus for selective stationary positioning within a bowling alley, with the apparatus being selectively coin-operated.

Another object of the present invention is to provide a bowling ball warming apparatus in the form of a bowling bag for portable use.

Other objects and details of the invention will become apparent from the following description when read in conjunction with the accompanying drawings.

BRIEF DESCRIPTION OF THE DRAWINGS

FIG. 1 illustrates a front perspective view of a first portable embodiment of the present invention.

FIG. 2 depicts a view of the apparatus taken along line 2—2 of FIG. 1.

FIG. 3 illustrates a front elevational view of an opened stationary embodiment of the apparatus.

FIG. 4 depicts a view taken along line 4—4 of FIG. 3.

DETAILED DESCRIPTION OF PREFERRED EMBODIMENTS

With reference to FIG. 1, there is depicted a first portable embodiment of the apparatus in accordance with the present invention. The apparatus includes a ball receiving member in the form of a spherically-shaped bowling ball bag 1. A handle 2 is disposed near the top portion of the bag 1 to facilitate carrying thereof. The bag 1 is fabricated of substantially flexible material, and a zipper 3 functions to open and close the bag from the ambient along an opening of sufficient length to permit a bowling ball to be easily received therein. A base 4 disposed adjacent the lower portion of the bag 1 functions to provide stability for the bag 1 when it is rested on a substantially horizontal surface.

Referring to FIG. 2, a detailed illustration of the fabrication of the bag 1 is depicted. The outer layer 5 of the bag 1 comprises a thermal insulating layer which can be fabricated of any suitable insulating material to thus substantially seal the bag 1 from ambient conditions. Adjacent the outer layer 5 is an inner layer 6 which functions to transmit heat to the bowling ball 8 with which it is co-extensively adapted to be in contact with. Heating is supplied as follows. A plurality of electrical resistance wires 7 are disposed within the inner layer 6 of the bag 1 at desired spaced apart intervals so as to transmit an even layer of heat to the transmitting layer 6 which is fabricated preferably of electrically insulative material. Because the inner layer 6 is co-extensive with the entire inner surface of the bag 1, and directly contacts substantially the entire periphery of the ball 8, there is thus effected an even and substantial heating of the ball 8. Power is supplied to the electrical resistance wires 7 selectively by various alternative means. If desired, batteries 9 (FIG. 1) can selectively supply power to the resistance wires 7 in a conventional manner. Battery operation of the apparatus permits the apparatus to be employed at any location, without the need for an outside power source. If desired, power can alternatively be supplied to the wires 7 in a conventional manner by means of a plug 10 adapted to be received in a conventional electrical outlet. Further, power can alternatively be supplied by a plug 11 (FIG. 1) adapted to be received in a conventional manner by an automobile cigarette lighter receptacle connected to the automobile's electrical system. The alternative power sources for the bag 1 permit use of the bag in any desired location. It should be noted that a ball 8 which has been exposed to substantially cold outdoor temperature conditions will be readily and effectively heated to a desired temperature, such as room temperature, to thus provide a thoroughly warmed bowling ball to the user when it is desired to employ same for game use.

Referring now to FIG. 3, an alternative stationary embodiment of the apparatus is depicted. This embodiment of the invention is particularly adapted for stationary use within a bowling alley, to thus provide convenient use thereof to various users of the lanes of the alley. The ball receiving member in this embodiment comprises a substantially rigid upper lid portion 12 which is hemispherically shaped, and a substantially rigid lower base portion 13 which is also hemispherically shaped. The lid 12 is pivotably secured to the base 13 by means of a hinge 14. The lid 12 includes a lower peripheral edge portion 12' which is adapted to substantially mate with the upper peripheral edge portion 13' of the base 13, to thus effect substantial sealing of the apparatus against the ambient when the apparatus is in a closed position as depicted in FIG. 4. A handle 15 disposed on the lid 12 permits ready opening and closing of the apparatus by the user. The base 13 is secured to platform means, such as legs 16, to permit the apparatus to be selectively positioned on a suitable horizontal surface, such as a floor surface, within the bowling alley at an easily accessible position to the user.

Referring now to FIG. 4, the construction of the apparatus as depicted in FIG. 3 will be explained in greater detail. The lid 12 includes an outer wall 12*a* which is substantially continuous to prevent air penetration therethrough. The base 13 is provided with a similar continuous outer wall 13*a*. An inner wall 12*b* is spaced apart from the outer wall 12*a* of the lid 12 as depicted, and is provided with many perforations 12*b*' at spaced intervals. A similar inner wall 13*b* is spaced apart from the outer wall 13*a* of the base 13 and is provided with many spaced perforations 13*b*'. The space between the inner and outer walls of the lid 12 and base 13 is interconnected by cooperating mating air passages 12" and 13" provided in the mating peripheral edges 12' and 13', respectively.

The heat supply means for this embodiment of the invention is provided as follows. A fairly large aperture 17 is provided in the outer wall 13*a* of the lower portion of the base 13, and attached adjacent the sides thereof is a casing 18 having a plurality of heating coils 19 disposed therein. A blower fan 20 is disposed on a housing 28 adjacent the heat coils 19 to cooperate therewith. An air inlet 21 is provided beneath fan 20 in housing 28 to supply ambient air thereto through a screen 22. Connected to the fan 20 to power same is an electric motor 23 disposed on a motor mount 24 which is disposed on the housing 28. The motor 23 and coils 19 are each connected to an electrical source, such as a conventional electrical outlet (not shown). Actuation of the motor 23 and coils 19 is provided by a coin operated starter 26 provided with a coin slot 25 connected thereto. In addition, the coin starter 26 is preferably provided with a timing mechanism therein.

The heat supply means operates as follows. Upon insertion of a coin into the slot 25, the starter unit 26 will be actuated to in turn start the electric motor 23 and heat coils 19. The fan 20 will be actuated by motor 23 and will draw ambient air in through inlet 21 and screen 22. The drawn air will be directed by fan 20 in the direction of the arrow in FIG. 4 over and around the heat coils 19 and up into the space between outer wall 13*a* and inner wall 13*b* of base 13. The thus heated air will pass through the perforations 13*b*' to heat the lower half of a bowling ball 27 as indicated by the arrows, with a substantial portion of the air passing through air passages 13", 12" into the space between the inner wall 12*b* and outer wall 12*a* of lid 12. In this manner, the top portion of the bowling ball 27 will be heated by heated air directed through perforations 12*b*' as indicated by the arrows in FIG. 4. In general, the heated air directed through the perforations 13*b*' and 12*b*' will function to substantially heat the entire peripheral portion of the ball 27. In this connection, it should be noted that the inner walls 12*b* and 13*b* are dimensioned so as to closely encompass the ball 27 to thus enhance the heating thereof. A pair of air vents 29 (FIG. 3) are provided in the peripheral edge 12' to permit escape of the heated air after it has contacted the ball 27 to prevent a build-up of air pressure within the apparatus.

It can thus be seen that to actuate the apparatus as depicted in FIGS. 3 and 4, the user has merely to place his bowling ball onto the inner wall 13*b* of the base 13 as depicted in FIG. 3, close the lid 12 by means of handle 15, and insert the proper coin or coins into the coin slot 25 to actuate the apparatus. The coined timer preferably provided within the starter 26 will function to regulate the length of time for heating the ball to the desired room temperature, and an audible or visual indicating device can be employed to alert the user to the completion of the heating operation. In this manner, when the cold ball is brought from outdoors into the bowling alley for game use, the ball can be first readily and effectively heated to a desired room temperature to thus eliminate discomfort to the user and possible cracking or breaking of the ball.

Although there have been described what are at present considered to be the preferred embodiments of the invention, the present invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description.

I claim:

1. A bowling ball warming apparatus comprising:

a first ball receiving member provided with an opening for receiving a conventional bowling ball to be warmed;

said first ball receiving member being spherical and having an inner spherical surface which is dimensioned so as to closely receive and entirely closely cover the spherical peripheral surface of said conventional bowling ball to be warmed;

closure means cooperating with said opening to substantially seal said first member from the ambient;

said first member being provided with inner heating means substantially co-extensive with the entire inner spherical surface of said first member for uniformly heating the entire spherical perhipheral surface of said conventional bowling ball to be warmed;

an electrical power source connected to said inner heating means;

said first member including a base portion pivotably connected to a lid portion, said base portion and said lid portion being each hemispherically shaped;

said closure means comprising mating peripheral edge portions of said base portion and said lid portion;

said base portion being secured to platform means for permitting said first member to be selectively stationarily positioned at a predetermined distance above a suitable horizontal surface;

said base portion and said lid portion being each defined by a substantially continuous outer wall and a spaced apart substantially perforated hemispherical inner wall, said inner perforated wall of each said base portion and said lid portion being provided with a continuous series of spaced apart apertures disposed substantially throughout the entire hemispherical surface of each of said inner walls; and said inner heating means comprising a blower fan adapted to cooperate with heating coils so as to direct heated air into the space between said outer wall and said inner wall of both said base portion and said lid portion and through said apertures of said perforated inner walls so as to heat the entire peripheral surface of said conventional bowling ball to be warmed.

2. A ball warming apparatus in accordance with claim 1, wherein:

said apparatus is further provided with means for actuating said apparatus by coin operation.

3. A ball warming apparatus in accordance with claim 1, wherein:

said lid portion is provided with a handle disposed on the continuous outer wall thereof;

said blower fan and heating coils are disposed adjacent an opening provided in said continuous outer wall of said base portion so as to direct heated air therethrough;

said mating peripheral edge portions of said base portion and said lid portion include mating air passage means for permitting said heated air to pass from the space between said outer and inner wall of said base portion to the space between said outer and inner wall of said lid portion; and said mating peripheral edge portions being further provided with at least one air vent.

4. A ball warming apparatus in accordance with claim 3, wherein:

said apparatus is further provided with means for actuating said apparatus by coin operation.

* * * * *